US007533544B1

(12) United States Patent
Billington

(10) Patent No.: US 7,533,544 B1
(45) Date of Patent: May 19, 2009

(54) CROCHET TOOL AND KIT

(76) Inventor: Pauline S Billington, 2070 Wilson Ave., Jacksonville, FL (US) 32207

( * ) Notice: Subject to any disclaimer, the term of this patent is extended or adjusted under 35 U.S.C. 154(b) by 0 days.

(21) Appl. No.: 12/142,038

(22) Filed: Jun. 19, 2008

Related U.S. Application Data

(60) Provisional application No. 61/001,810, filed on Nov. 5, 2007.

(51) Int. Cl.
*D04B 3/00* (2006.01)

(52) U.S. Cl. ..... 66/1 A

(58) Field of Classification Search ..... 66/1 A, 66/1 R, 116, 117, 118
See application file for complete search history.

(56) References Cited

U.S. PATENT DOCUMENTS 2,117,143 A * 5/1938 Burger ..... 66/117
2,414,353 A * 1/1947 Birmingham ..... 66/117
2,539,479 A * 1/1951 Robertson ..... 66/1 A
2,603,957 A * 7/1952 Brooks ..... 66/1 A
4,846,351 A * 7/1989 Gardiner ..... 206/574

* cited by examiner

*Primary Examiner*—Danny Worrell
(74) *Attorney, Agent, or Firm*—Coats & Bennett, P.L.L.C.

(57) ABSTRACT

A crochet tool is designed to make the process of forming loops easier. The tool has a handle section and at least one working section that extends from the handle section along an axis. The working section has a hollow bore terminating at a end opening disposed generally transverse to the axis and opening away from the handle; a sidewall; and a side aperture in the sidewall that opens into the bore and is sized to allow a crochet hook tip to pass therethrough. The crochet tool may have a second working section extending from the other end of handle section that is substantially similar to the first working section, but with a different outer dimension so as to be smaller or larger. The two working sections may collinear, with the handle section optionally tapering therebetween. A kit of such tools is also described.

16 Claims, 4 Drawing Sheets

CROCHET TOOL AND KIT

This application claims benefit of U.S. Provisional Application No. 61/001,810, filed 5 Nov. 2007, the disclosure of which is incorporated herein by reference.

BACKGROUND

In crocheting, it is common to form loops. Unfortunately, the loop formation process can be difficult and time consuming to achieve. While a number of approaches have been tried over the years for forming loops, none has proved entirely acceptable. As such, there remains a need for crochet tools, or kits thereof, that facilitate the loop forming process.

SUMMARY

The present invention is directed generally to a crochet tool or a kit containing a plurality of the crochet tools. More specifically, the present invention is directed to a crochet tool that is designed to make the process of forming loops easier. In one illustrative embodiment, the crochet tool comprises a handle section and at least a first working section extending from the handle section in a first direction along a first longitudinal axis. The first working section comprises a first hollow bore terminating at a first end opening disposed generally transverse to the first axis and opening away from the handle section; a first peripheral sidewall disposed about the first bore; and a first side aperture in the first sidewall that opens into the first bore and is sized to allow a crochet hook tip to pass therethrough. The first side aperture may extend to the first end opening so that the side aperture and the end opening are essentially fused together. The first sidewall may be generally cylindrically shaped and extend more than 180° around the first axis. The exterior surface of the first sidewall may, if desired, be oriented parallel to the first axis so that the corresponding end section has a constant outer dimension (e.g., diameter if round in cross-section). The first bore may extend into the handle section. In some embodiments, the crochet tool includes a second working section extending from the other end of handle section in a second direction, generally opposite the first direction. The second working section may be substantially similar to the first working section, but advantageously with a different outer dimension so as to be smaller or larger. The two working sections may be oriented so that their respective axes are collinear, and the handle section may taper from the larger working section to the smaller working section. The handle section may be hollow with a bore therein that connects the bores in the respective working sections, if desired.

A kit of multiple of such tools can be formed with tools of different sizes, and optionally with multiples instances of the same size tools.

The various aspects of the various embodiments may be used alone or in any combination, as is desired.

DETAILED DESCRIPTION

Figure 1:
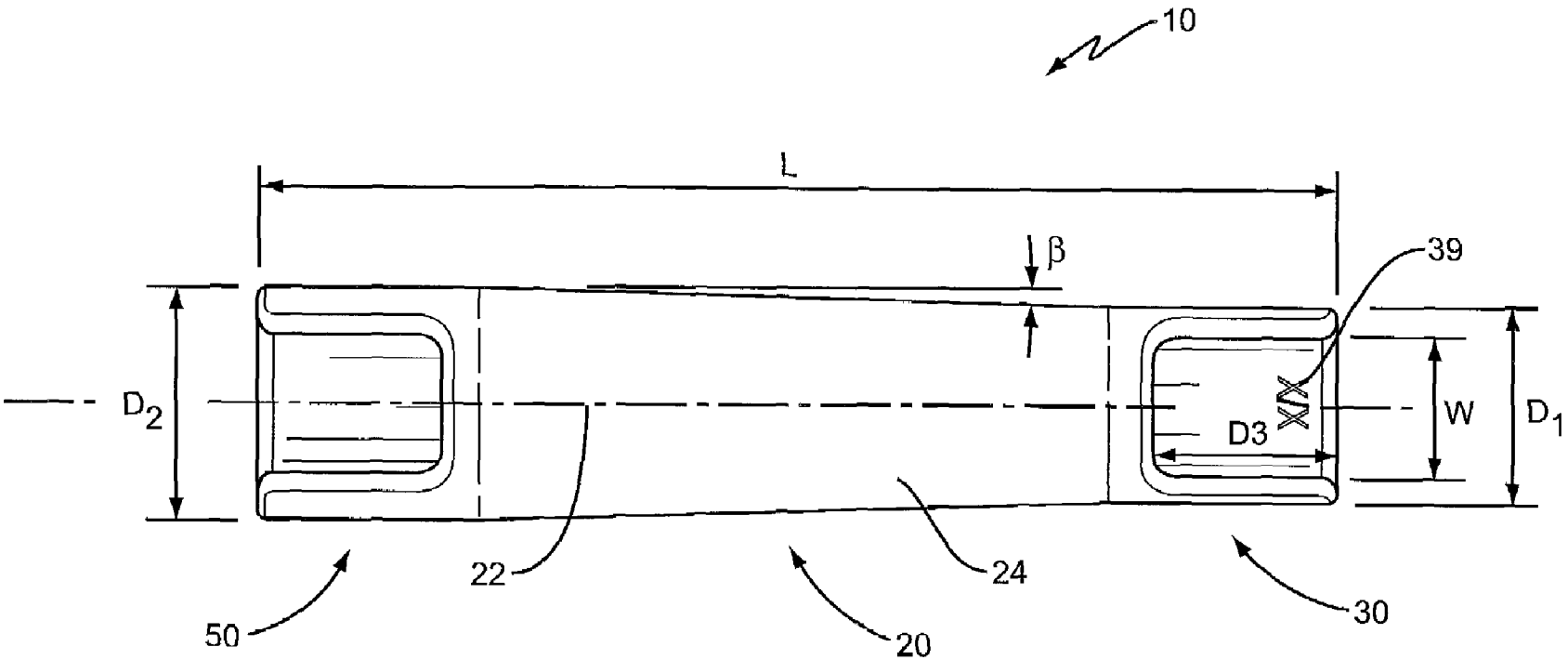
FIG. 1 shows a side view of a crochet tool according to one embodiment.
Figure 2:
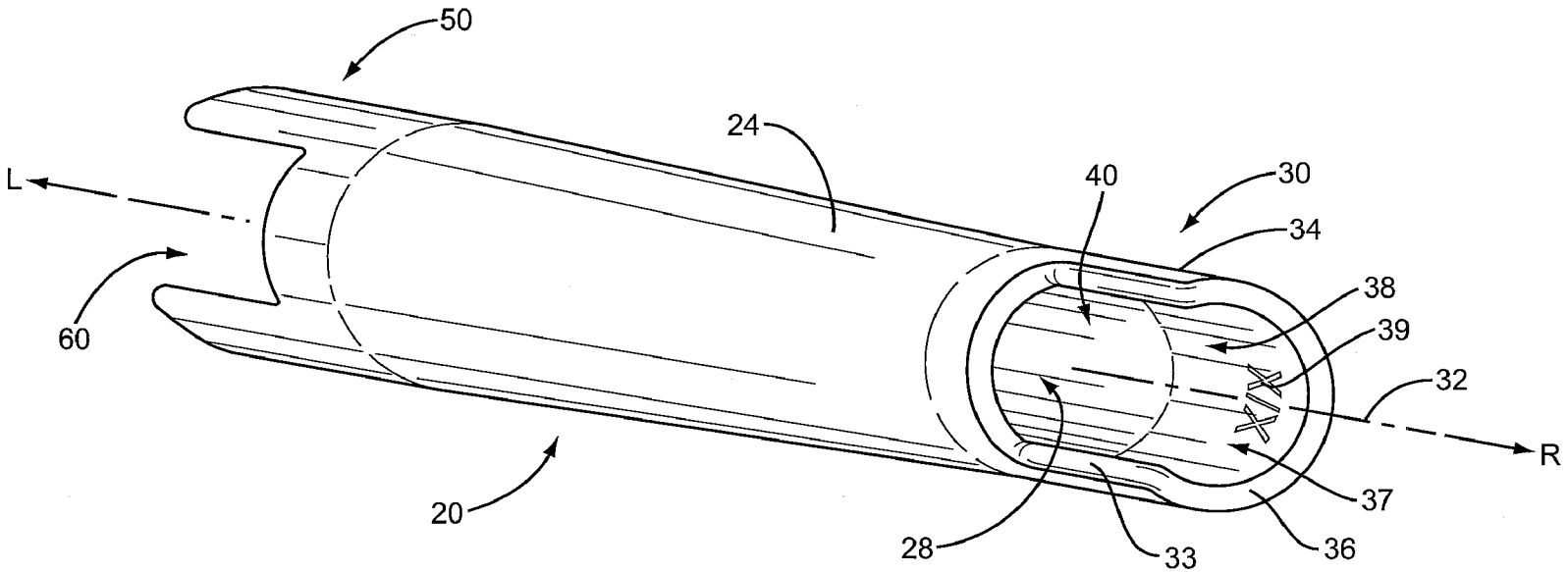
FIG. 2 shows a detail view of one working section of the crochet tool of FIG. 1.
Figure 3:
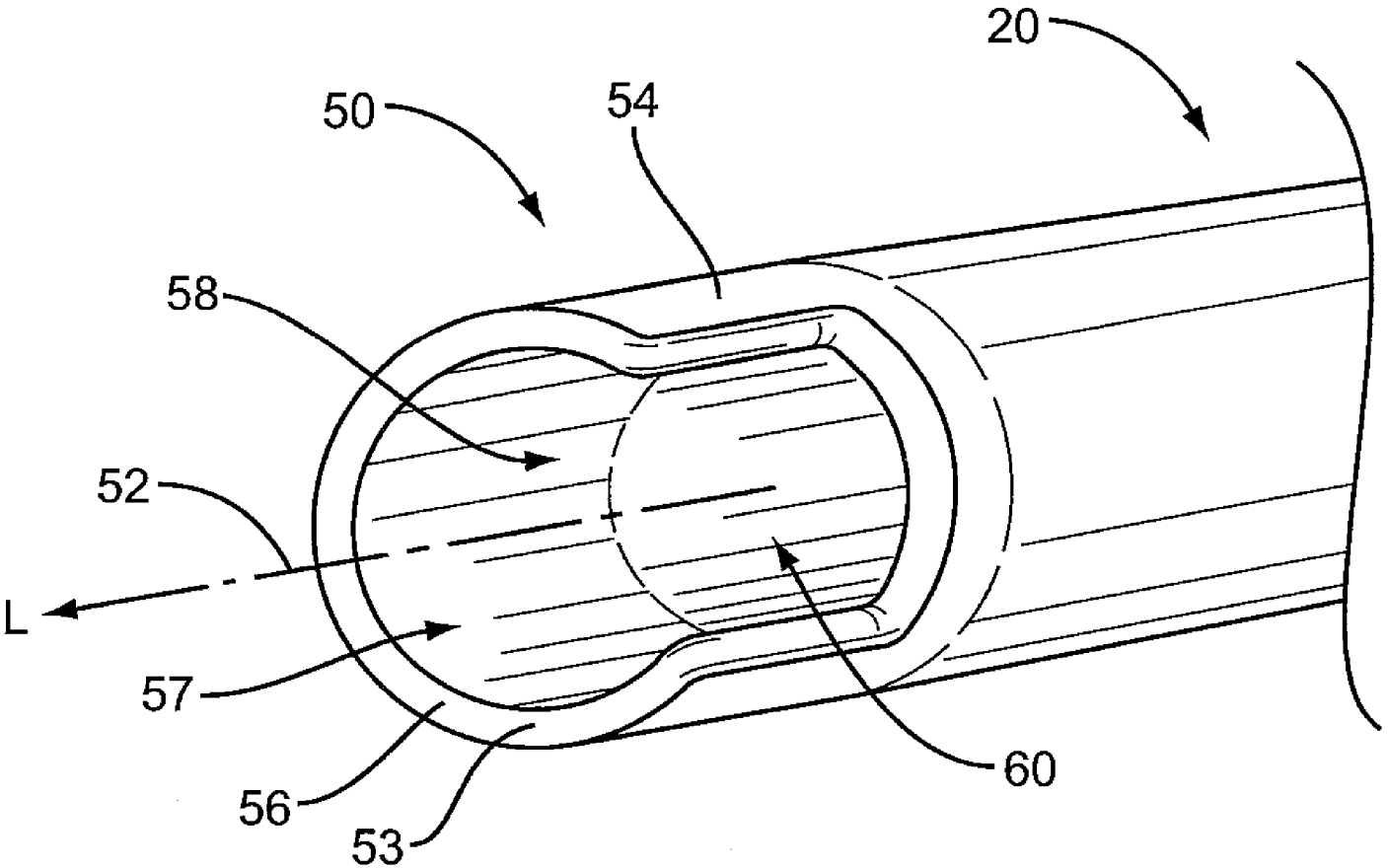
FIG. 3 shows a detail view of another working section of the crochet tool of FIG. 1.
Figure 4:
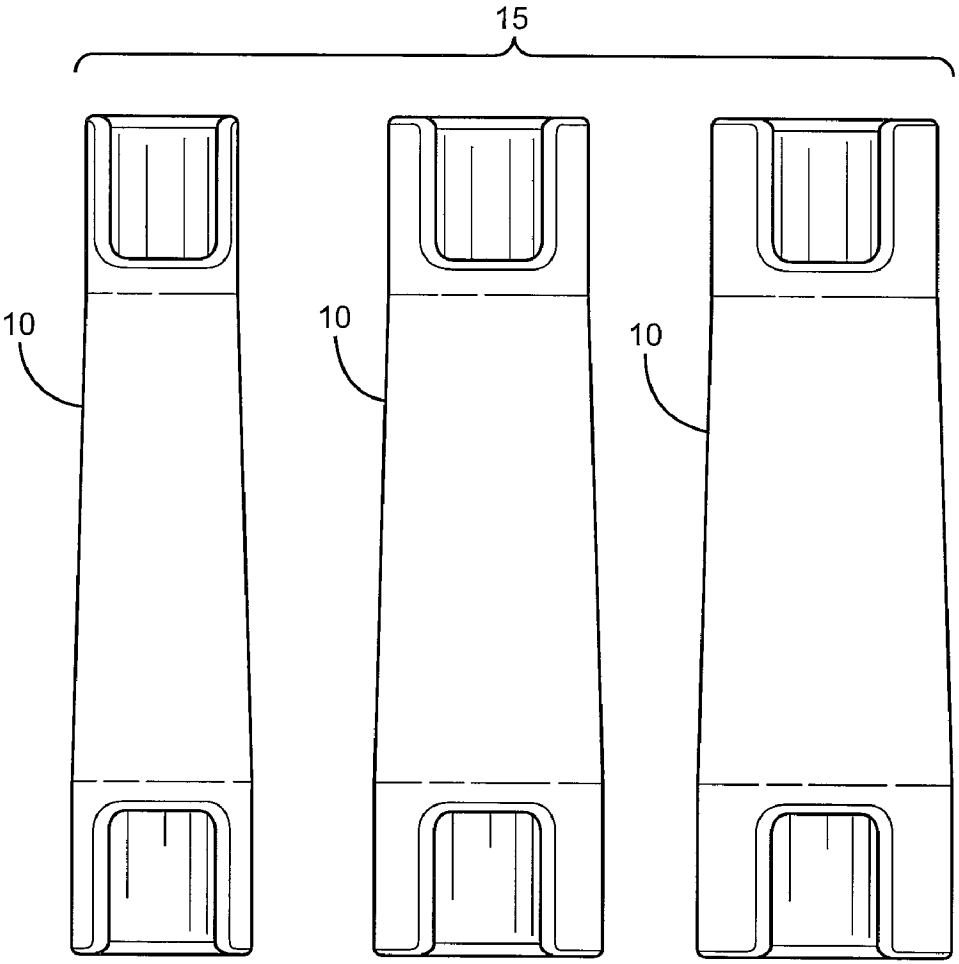
FIG. 4 shows a kit of the crochet tools according to one embodiment.

The various embodiments disclosed herein are directed to a crochet tool and/or a kit of crochet tools. As illustrated in FIG. 1, a crochet tool, generally designated 10, may include a central handle section 20 and respective end or working sections 30,50. The handle section 20 extends along longitudinal axis 22 may have any suitable cross-sectional shape. For example, the handle section 20 may be generally cylindrical, somewhat elliptical, or faceted. In some embodiments, the exterior surface 24 of handle section 20 may be tapered, such by narrowing from end section 50 to end section 30 at a taper angle β. The handle section 20 may be solid, but is advantageously hollow such that a central passage 28 extends therethrough along axis 22.

Right end section 30 extends outward from handle section 20 along longitudinal axis 32 to an endface 36. A hollow bore 38 extends inward from an end opening 37 in endface 36. The bore 38 may extend partially toward handle section 20 or may extend all the way to, or into, handle section 20. A peripheral sidewall 33 is disposed about bore 38. The sidewall 33 includes a side opening 40, sometimes referred to herein as a notch, so that sidewall 33 only partially surrounds bore 38, such as extending somewhat over 180° around bore 38. The notch 40 is advantageously defined by a generally U-shaped edge that is open toward endface 36. Thus, the notch 40 advantageously opens into bore 38 and into end opening 37. Notch 40 is sized to allow a crochet hook tip to pass therethrough, as discussed further below. The sidewall 33 may, but is not required to, have a generally cylindrical shape so that the exterior surface 34 of sidewall 33 is disposed parallel to axis 32. Under such circumstances, the outer dimension D1 of working section 30 is constant.

Left end section 50 also extends outward from handle section 20, advantageously in a direction L that that is generally opposite to the extension direction R of end section 30. The configuration of end section 50 is similar to end section 30, but typically of a different size. Thus, in one embodiment, end section 50 extends outward from handle section 20 along longitudinal axis 52 to an endface 56. A hollow bore 58 extends inward from an end opening 57 in endface 56. The bore 58 may extend partially toward handle section 20 or may extend all the way to, or into, handle section 20. A peripheral sidewall 53 is disposed about bore 58. The sidewall 53 includes a side opening 60, sometimes referred to herein as a notch, so that sidewall 53 only partially surrounds bore 58, such as extending somewhat over 180° around bore 58. Notch 60 is advantageously defined by a generally U-shaped edge that is open toward endface 56. Thus, notch 60 advantageously opens into bore 58 and into end opening 57. Notch 60 is sized to allow a crochet hook tip to pass therethrough, as discussed further below. The sidewall 53 may, but is not required to, have a generally cylindrical shape so that the exterior surface 54 of sidewall 53 is disposed parallel to axis 52. Under such circumstances, the outer dimension D2 of working section 50 is constant.

In some embodiments, end sections 30,50 may be disposed in an offset configuration. However, in some embodiments the end sections 30,50 are arranged so that their axes 32,52 are collinear. Indeed, in some embodiments where handle section 20 is hollow, the handle section bore 28 may connect the end section bores 38,58, advantageously so that all three axes 22,32,52 are collinear. The overall length of the tool 10 may be approximately 3½ inches, or as desired.

The notches 40,60 are advantageously similarly sized. For example, the notches may both have a depth D3 along the respective axis 32,52 of ⅝ inch, with a width W of ¼ inch. In contrast, the end sections 30,50 are advantageously of different sizes. For example, the end sections 30,50 may differ in outer dimensions by 1/16 inch, with the smaller end being (if round) 3/8 inch diameter, 1/2 inch diameter, 5/8 inch diameter, 3/4 inch diameter, or other appropriate size. The size of a given notch 40,60 is advantageously indicated with suitable indicia 39 (e.g., embossed characters) which may be located as desired, such as on the surface 24 of handle section 20 proximate the corresponding notch 30,50 and/or on inner or outer surface of sidewall 33,53 of the respective end section 30,50. Further, a kit 15 of multiple crochet tools 10 can be formed with crochet tools of different sizes, and optionally some multiples of the same size crochet tool(s).

The discussion above has used as an illustrative example a tool 10 having two working end sections 30,50 disposed on opposite sides of handle section 20. However, in some embodiments, the tool 10 may have only one working end section 30, if desired. Further, some embodiments of the tool 10 may have more than two working sections 30,50, arranged as desired about the handle section 20.

The crochet tool 10 may be fabricated from any suitable material, such as aluminum, stainless steel, various plastics, ceramics, or other materials known in the art. Advantageously, the exterior surfaces 34,54 of the working sections 30,50 are relatively smooth so as to not snag any crochet yarn, while the exterior surface 24 of handle section 20 may be textured to improve grip.

The crochet tool 10 may be used to generate a variety of loop stitches. For example, the tool 10 can be used to make a free loop stitch. To make the free loop stitch, a suitable number of regular stitches are formed, such as according to a selected set of instructions or pattern. Based on the desired size of the resulting loop, the corresponding working end 30,50 of the tool, and/or the correct tool 10, is selected. For purposes of illustration, it is assumed that working end 30 is selected. The yarn is then wrapped around the working end 30 of the tool 10 as many times as is desired, such as three times, with the workpiece and crochet hook on one side and the free (or "working") yarn on the other side of the tool 10. With the hook close to the working end 30, insert the tip of the hook into notch 30, under the wrapped yarn and in the handle-to-endface direction, until the hook tip extends out endface 36 through end opening 37. The working yarn is hooked and slightly pulled toward the handle section 20 by pulling back on the hook. With the hook advantageously oriented at a relatively low angle (toward parallel) with respect to axis 32 of working section 30, the common crocheting maneuver of a yarn-over-hook is performed. The stitch formed thereby is then pulled back under the wrapped yarn by pulling the hook tip toward the handle section 20 until the yarn can be routed around (over) the wrapped yarn. The hook tip is then moved outward (e.g., radially out) from notch opening 40 and forward (toward the endface 37), and another yarn-over-hook maneuver is performed. The stitch is then pulled through the remaining loops on the hook. The free loop stitch is now complete. Note that for this free loop stitch, one does not "gain" a stitch and one will therefore need to skip a stitch and continue with the other stitching instructions/pattern as before. Also, note that the size of the end section 30 selected will help determine the size of the resulting loops formed by the free loop stitch. Of course, it should be understood that other stitches may be formed using the same or similar tool 10, and the free loop stitch process described above is but one of the many possible crochet stitching process that may use the present tool 10.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A crochet tool, comprising:

a handle section;

a first working section extending from said handle section in a first direction along a first longitudinal axis;

said first working section comprising:

a first hollow bore terminating at a first end opening disposed generally transverse to said first axis and opening away from said handle section;

a first peripheral sidewall disposed about said first bore;

a first side aperture in said first sidewall that opens into said first bore and is sized to allow a crochet hook tip to pass therethrough;

a second working section extending from said handle section in a second direction, generally opposite said first direction, along a second longitudinal axis;

said second working section comprising:

a second hollow bore terminating at a second end opening disposed generally transverse to said second axis;

a second peripheral sidewall disposed about said second bore;

a second side aperture in said second sidewall that opens into said second bore and is sized to allow a crochet hook tip to pass therethrough.

2. The crochet tool of claim 1 wherein said first side aperture extends to said first end opening.

3. The crochet tool of claim 1 wherein said first sidewall of said first working section is generally cylindrically shaped and extends more than 180° around said first axis.

4. The crochet tool of claim 1 wherein said first bore extends into said handle section.

5. The crochet tool of claim 1 wherein an exterior surface of said first sidewall is oriented parallel to said first axis.

6. The crochet tool of claim 1 wherein said handle section comprises an exterior surface that tapers between said first and second working sections.

7. The crochet tool of claim 1 wherein said handle section comprises a third bore that operatively connects said first bore to said second bore.

8. The crochet tool of claim 7 wherein said first, second, and third bores are collinear.

9. The crochet tool of claim 1 wherein an exterior surface of said second sidewall is oriented parallel to said longitudinal axis.

10. The crochet tool of claim 1 further comprising first and second indicia in said first and second working sections, respectively, corresponding to a circumferential dimension of the corresponding working section.

11. A crochet tool kit, comprising:

a plurality of crochet tools, including a first tool and a second tool, the first and second tools each comprising:

a handle section;

a first working section extending from said handle section in a first direction along a first longitudinal axis;

said first working section comprising:

a first hollow bore terminating at a first end opening disposed generally transverse to said first axis and opening away from said handle section, a first peripheral sidewall disposed about said first bore and having a peripheral dimension;

a first side aperture in said first sidewall that opens into said first bore and is sized to allow a crochet hook tip to pass therethrough;

wherein the peripheral dimensions of said first working sections of said first and second tools are different;

wherein said first and second tools each further comprise:

a second working section extending from said handle section in a second direction, generally opposite said first direction, along a second longitudinal axis;

said second working section comprising:

a second hollow bore terminating at a second end opening disposed generally transverse to said second axis;

a second peripheral sidewall disposed about said second bore;

a second side aperture in said second sidewall that opens into said second bore and extends to said second opening and is sized to allow a crochet hook tip to pass therethrough.

12. The crochet tool of claim 2 wherein said second side aperture extends to said second end opening.

13. The crochet tool of claim 3 wherein said second sidewall of said second working section is generally cylindrically shaped and extends more than 180° around said second axis.

14. The crochet tool of claim 5 wherein an exterior surface of said second sidewall is oriented parallel to said second axis.

15. The crochet tool kit of claim 11 wherein, for each of said first and second tools:

said first and second side apertures extend to said first and second end openings, respectively;

said first sidewall of said first working section is generally cylindrically shaped and extends more than 180° around said first axis;

said second sidewall of said second working section is generally cylindrically shaped and extends more than 180° around said second axis.

16. The crochet tool kit of claim 11 wherein, for each of said first and second tools:

said handle section comprises an exterior surface that tapers between said first and second working sections;

said handle section comprises a third bore that operatively connects said first bore to said second bore;

said first, second, and third bores are collinear.

* * * * *